US012714209B2

(12) United States Patent
Ng et al.

(10) Patent No.: US 12,714,209 B2
(45) Date of Patent: Aug. 25, 2026

(54) AUTOLOOM

(71) Applicant: Choon's Design LLC, Farmington Hills, MI (US)

(72) Inventors: Cheong Choon Ng, Novi, MI (US); Zilan Zhou, Novi, MI (US); James Haven, Commerce Township, MI (US)

(73) Assignee: CHOON'S DESIGN LLC, Farmington Hills, MI (US)

( * ) Notice: Subject to any disclaimer, the term of this patent is extended or adjusted under 35 U.S.C. 154(b) by 42 days.

(21) Appl. No.: 18/658,171

(22) Filed: May 8, 2024

(65) Prior Publication Data

US 2025/0347038 A1 Nov. 13, 2025

(51) Int. Cl.
*A44C 27/00* (2006.01)
*D04C 7/00* (2006.01)

(52) U.S. Cl.
CPC ..... *A44C 27/00* (2013.01); *D04C 7/00* (2013.01)

(58) Field of Classification Search
CPC ..... D04C 7/00; A44C 27/00; A61C 7/306; B65H 69/04
USPC ..... 289/17
See application file for complete search history.

(56) References Cited

U.S. PATENT DOCUMENTS

| | | | |
|---|---|---|---|
| 38,192 | A | 4/1863 | Wilcox |
| 86,119 | A | 1/1869 | Allport |
| 222,937 | A | 12/1879 | Newcomb |
| 246,648 | A | 9/1881 | Wilcox |
| 254,258 | A | 2/1882 | Barbour |
| 254,288 | A | 2/1882 | Dimmick |
| 266,958 | A | 10/1882 | Gordon |
| 289,578 | A | 12/1883 | Stewart |
| 426,087 | A | 4/1890 | Wolkow |
| D29,965 | S | 1/1899 | Blakeslee |
| 763,303 | A | 6/1904 | Mayers |
| 782,657 | A | 2/1905 | Hubert |

(Continued)

FOREIGN PATENT DOCUMENTS

| | | | |
|---|---|---|---|
| CH | 201594 | A | 12/1938 |
| DE | 521894 | C | 3/1931 |

(Continued)

OTHER PUBLICATIONS

Translation KR 200477037.*

(Continued)

*Primary Examiner* — Shaun R Hurley
(74) *Attorney, Agent, or Firm* — Carlson, Gaskey & Olds, P.C.

(57) ABSTRACT

A device for forming an item from closed loop elastic bands includes a guide having a cam surface and at least two poles spaced apart from each other. The poles are configured to hold at least one closed loop elastic band therebetween. A slider including at least two arms is movable relative to the at least two poles of the guide. Each of the at least two arms include a finger portion having a hook and a push surface. The hook is configured to pick a lowermost elastic band supported on a corresponding one of each of the at least two poles and the push surface configured to push the picked elastic band over the outwardly extending flange. Movement of the slider relative to the guide automatically drives movement of the fingers to lift and release an elastic band to form a link a linked item.

35 Claims, 15 Drawing Sheets

(56) References Cited

U.S. PATENT DOCUMENTS 843,495 A 2/1907 Sander
904,747 A 11/1908 Anderson
968,199 A 8/1910 Schwartz
1,020,963 A 3/1912 Cake
1,073,226 A 9/1913 Freeman
1,176,482 A 3/1916 Orme
D51,186 S 8/1917 Pearson
1,279,411 A 9/1918 Neuman
1,318,465 A 10/1919 Seifarth
1,318,604 A 10/1919 Schneider
1,366,212 A 1/1921 Pollard
1,375,119 A 4/1921 Stephen
1,405,744 A 2/1922 Sampliner
1,424,458 A 8/1922 Fleisher
1,500,383 A 7/1924 Gourie
1,599,040 A 9/1926 Clisby
1,647,060 A 10/1927 Eugen
1,694,849 A 12/1928 Sunao
1,705,860 A 3/1929 Eiichi
1,718,140 A 6/1929 Masa
1,776,561 A 9/1930 La
1,878,861 A 9/1932 Philip
1,994,659 A 3/1935 Ma
2,000,504 A 5/1935 Emile
2,072,668 A 3/1937 Eltgroth
2,108,424 A 2/1938 Bakely
2,134,066 A 10/1938 Ness
2,186,692 A 1/1940 Boyer et al.
2,236,325 A * 3/1941 Vorck ..... D04B 35/02 66/1 R
2,237,733 A 4/1941 Frederick et al.
2,270,619 A 1/1942 Bowyer
2,274,572 A 2/1942 Yates
2,318,018 A 5/1943 Semonsen
2,360,416 A 10/1944 Hamilton
D144,079 S 3/1946 Smith
2,413,998 A * 1/1947 Scott ..... A45D 26/0066 606/133
D146,830 S 5/1947 Kimmelstiel
2,424,880 A 7/1947 Robertson
2,433,307 A 12/1947 Wimberly
2,450,067 A 9/1948 Wolff
2,457,064 A 12/1948 Anthony
2,498,920 A 2/1950 Holland
2,540,383 A 2/1951 Edward et al.
2,545,409 A 3/1951 Mccall
2,600,091 A 6/1952 Becker
D167,727 S 9/1952 Teare
2,658,364 A 11/1953 Carlson
2,666,249 A 1/1954 Ruiz et al.
2,687,630 A 8/1954 Carlson
2,703,482 A 3/1955 Albin
2,707,052 A 4/1955 Brown
2,726,434 A 12/1955 Knoblock et al.
2,825,592 A 3/1958 Mckenzie
2,879,095 A 3/1959 Alois
2,984,488 A 5/1961 Kirchner
3,054,214 A 9/1962 Smith et al.
3,069,739 A 12/1962 Jorgenson et al.
3,112,491 A 12/1963 Cleveland
3,126,858 A 3/1964 Rosinski
D204,442 S 4/1966 Brawley, Jr.
3,276,181 A 10/1966 Gilbert
3,377,674 A 4/1968 Brassaw et al.
3,434,750 A 3/1969 Hetrick
3,438,098 A 4/1969 Grabner
3,438,223 A 4/1969 Linstead
3,476,423 A 11/1969 Kentfield
3,476,426 A 11/1969 Lewin
3,572,679 A 3/1971 Strauff
3,636,987 A 1/1972 Forby
3,648,484 A 3/1972 Gordon
3,665,971 A 5/1972 Ileks
3,672,679 A 6/1972 Burns
3,678,709 A 7/1972 Nowicki et al.
3,688,357 A 9/1972 Nielsen et al.
3,693,976 A 9/1972 Flack
3,728,762 A 4/1973 Hogg
3,748,706 A 7/1973 Doyel
3,758,923 A 9/1973 Maude
3,774,649 A 11/1973 Glessner
3,776,280 A 12/1973 Kliot
3,800,372 A 4/1974 Daoust
3,804,127 A 4/1974 Rose
3,805,345 A 4/1974 Antos
3,853,021 A 12/1974 Hayes
3,866,959 A 2/1975 Matarelli
3,905,133 A 9/1975 Charman
D238,812 S 2/1976 Fioretti
3,971,417 A 7/1976 Gentil
4,018,543 A 4/1977 Carson et al.
4,023,245 A 5/1977 Zaltzman
4,032,179 A 6/1977 Goss
4,037,513 A 7/1977 Hobson
D245,748 S 9/1977 Ostroll
4,066,271 A 1/1978 Lohr
D248,347 S 7/1978 McCollum
4,114,892 A 9/1978 Csoka
D250,338 S 11/1978 LaPierre
4,131,138 A 12/1978 Boisvert
4,179,129 A 12/1979 Loomis
D257,257 S 10/1980 McArthur
4,248,063 A 2/1981 Wang
4,416,040 A 11/1983 Towsley
D273,588 S 4/1984 Barrett
4,525,003 A * 6/1985 Tate, Jr. ..... B65H 69/04 289/17
D279,938 S 8/1985 Okada
4,563,812 A 1/1986 Goddard-Watts
4,569,108 A 2/1986 Schwab
4,607,869 A 8/1986 Bersche
4,629,100 A 12/1986 Owens
4,667,965 A 5/1987 Helms, Jr.
4,680,021 A 7/1987 Maxim
4,729,229 A 3/1988 Whicker
4,844,473 A 7/1989 Landsberg
D310,672 S 9/1990 Harvey et al.
5,104,160 A 4/1992 Cheng
D330,668 S 11/1992 Nagamatsu
5,163,946 A 11/1992 Li
5,230,295 A 7/1993 Shell
5,231,742 A 8/1993 Macbain
5,295,280 A 3/1994 Hudson et al.
5,328,374 A 7/1994 Stevens
5,331,725 A 7/1994 Chou
5,377,595 A 1/1995 Liu
5,426,788 A 6/1995 Meltzer
5,437,459 A 8/1995 Kirby
5,459,905 A 10/1995 Voyre
5,562,456 A 10/1996 Cianciotto
5,575,643 A * 11/1996 Green ..... A61C 7/306 606/140
5,577,299 A 11/1996 Thompson et al.
5,639,090 A 6/1997 Stevens
5,687,775 A 11/1997 Thompson et al.
D389,050 S 1/1998 Li
5,713,094 A 2/1998 Markey et al.
D406,749 S 3/1999 Selk
5,888,392 A 3/1999 Frizell
5,916,283 A 6/1999 Steinbach
5,927,764 A 7/1999 Harriman
D425,784 S 5/2000 Beugelsdyk et al.
6,065,968 A 5/2000 Corliss
D426,425 S 6/2000 Hermanski
6,122,859 A 9/2000 Lazar
6,129,551 A 10/2000 Martin
6,131,778 A 10/2000 Etzion
6,146,144 A 11/2000 Fowler et al.
6,149,436 A 11/2000 Dunn
6,164,289 A * 12/2000 Ogunro ..... A45D 2/00 87/8
6,171,317 B1 1/2001 Jackson et al.
6,209,930 B1 4/2001 Johnston et al.
6,213,918 B1 4/2001 Rogers, Jr.

(56) References Cited

U.S. PATENT DOCUMENTS

| | | | | |
|---|---|---|---|---|
| 6,389,652 | B1 | 5/2002 | Williams | |
| 6,412,833 | B2 | 7/2002 | Lusk et al. | |
| 6,550,177 | B1 | 4/2003 | Epple, Jr. | |
| D478,738 | S | 8/2003 | Workman | |
| 6,880,364 | B1 | 4/2005 | Vidolin et al. | |
| 6,902,212 | B1 | 6/2005 | Mize | |
| 6,923,026 | B1 | 8/2005 | Clarke | |
| 7,040,120 | B2 | 5/2006 | Hunter | |
| D522,352 | S | 6/2006 | Van Straaten | |
| 7,264,282 | B2 | 9/2007 | Lambertz et al. | |
| D552,463 | S | 10/2007 | French et al. | |
| D562,358 | S | 2/2008 | Landmesser | |
| D563,997 | S | 3/2008 | Gustin | |
| D570,923 | S | 6/2008 | Vazquez Gastellu | |
| D578,383 | S | 10/2008 | Adams | |
| D582,221 | S | 12/2008 | Vendl | |
| 7,506,524 | B2 | 3/2009 | Gustin | |
| D592,537 | S | 5/2009 | Darnell | |
| 7,578,146 | B2 | 8/2009 | Gustin | |
| 7,585,004 | B1 | 9/2009 | Page | |
| 7,617,947 | B2 | 11/2009 | Schäfer | |
| D604,999 | S | 12/2009 | Ablo | |
| D608,189 | S | 1/2010 | Jackson et al. | |
| 7,666,196 | B1 | 2/2010 | Miles | |
| 7,677,677 | B1 | 3/2010 | Roberts | |
| 7,891,506 | B2 | 2/2011 | Kornowski | |
| 7,909,609 | B2 | 3/2011 | Molin | |
| D635,594 | S | 4/2011 | Novak | |
| D639,683 | S | 6/2011 | Essel | |
| 8,141,326 | B2 | 3/2012 | Wang | |
| 8,316,894 | B2 | 11/2012 | Schaub | |
| D676,069 | S | 2/2013 | Fujiwara | |
| 8,402,794 | B2 | 3/2013 | Sasur | |
| 8,418,434 | B1 | 4/2013 | Carruth et al. | |
| 8,485,565 | B2 | 7/2013 | Ng | |
| 8,510,916 | B2 | 8/2013 | Kinvi | |
| D690,191 | S | 9/2013 | Takakuwa et al. | |
| D696,576 | S | 12/2013 | Ng | |
| 8,596,096 | B1 | 12/2013 | Russell et al. | |
| 8,622,441 | B1 | 1/2014 | Ng | |
| 8,661,624 | B1 | 3/2014 | Bracewell | |
| 8,684,420 | B2 | 4/2014 | Ng | |
| D707,732 | S | 6/2014 | Crorey | |
| 8,746,753 | B2 | 6/2014 | Crorey | |
| D711,931 | S | 8/2014 | Daftari | |
| 8,899,631 | B2 | 12/2014 | Ng | |
| D721,744 | S | 1/2015 | Daftari | |
| 8,931,811 | B1 | 1/2015 | Ng | |
| 8,936,283 | B2 | 1/2015 | Ng | |
| 8,955,888 | B2 | 2/2015 | Ng | |
| 8,973,955 | B2 | 3/2015 | Ng | |
| 9,149,096 | B2 | 10/2015 | Ng | |
| D748,158 | S | 1/2016 | Ng | |
| 9,234,306 | B1 | 1/2016 | Chang | |
| D755,258 | S | 5/2016 | Ng | |
| 9,689,093 | B2 * | 6/2017 | Hamer | D04B 5/00 |
| 10,667,493 | B2 | 6/2020 | Blizzard et al. | |
| 2001/0030423 | A1 | 10/2001 | Lusk et al. | |
| 2004/0079109 | A1 | 4/2004 | Crova | |
| 2006/0028022 | A1 | 2/2006 | James | |
| 2007/0114340 | A1 | 5/2007 | Adams | |
| 2007/0199965 | A1 | 8/2007 | Gouldson | |
| 2007/0270010 | A1 | 11/2007 | Walter | |
| 2008/0156043 | A1 | 7/2008 | Gustin | |
| 2008/0223083 | A1 | 9/2008 | Gustin | |
| 2009/0215013 | A1 | 8/2009 | Molin | |
| 2010/0019495 | A1 | 1/2010 | Oliveto | |
| 2010/0269373 | A1 | 10/2010 | Pirkle et al. | |
| 2011/0067558 | A1 | 3/2011 | Saindon | |
| 2011/0152946 | A1 | 6/2011 | Frigg et al. | |
| 2011/0259465 | A1 | 10/2011 | Schaub | |
| 2012/0047960 | A1 | 3/2012 | Sasur | |
| 2012/0112457 | A1 | 5/2012 | Ng | |
| 2012/0150203 | A1 | 6/2012 | Brady et al. | |
| 2013/0020802 | A1 | 1/2013 | Ng | |
| 2013/0300114 | A1 | 11/2013 | Ng | |
| 2013/0307267 | A1 | 11/2013 | Ng | |
| 2014/0319835 | A1 | 10/2014 | Ng | |
| 2014/0373966 | A1 | 12/2014 | Nedry et al. | |
| 2015/0042091 | A1 | 2/2015 | Tommer et al. | |
| 2015/0265007 | A1 | 9/2015 | Ng | |
| 2015/0296937 | A1 * | 10/2015 | Ng | D04D 11/00 289/17 |
| 2015/0345051 | A1 | 12/2015 | Wright | |
| 2022/0049385 | A1 | 2/2022 | Ng | |

FOREIGN PATENT DOCUMENTS

| | | | | |
|---|---|---|---|---|
| GB | 2147918 | A | 5/1985 | |
| JP | S03-001676 | Y | 2/1928 | |
| JP | H09291447 | A | 11/1997 | |
| JP | 2003171854 | A | 6/2003 | |
| JP | 2003520083 | A | 7/2003 | |
| JP | 2004520910 | A | 7/2004 | |
| JP | D1393632 | | 8/2010 | |
| JP | D1501836 | | 7/2014 | |
| JP | D1501837 | | 7/2014 | |
| KR | 20010012609 | A | 2/2001 | |
| KR | 20060042108 | A | 5/2006 | |
| KR | 300503642 | | 5/2008 | |
| KR | 200477037 | Y1 * | 5/2015 | A44C 27/00 |
| WO | 2012060906 | A1 | 5/2012 | |
| WO | 2014190255 | A1 | 11/2014 | |
| WO | 2024059002 | A1 | 3/2024 | |

OTHER PUBLICATIONS

Petition for Inter Partes Review of U.S. Pat. No. 8,485,565 and Exhibits, filed in the United States Patent and Trademark Office on May 1, 2015, Case No. IPR2015-01139.

Petition for Inter Partes Review of U.S. Pat. No. 8,622,441 and Exhibits, filed in the United States Patent and Trademark Office on Mar. 3, 2015, Case No. IPR2015-00840.

Petition for Inter Partes Review of U.S. Pat. No. 8,684,420 and Exhibits, filed in the United States Patent and Trademark Office on May 4, 2015, Case No. IPR2015-01143.

The Horde of Vigdis, Aug. 5, 2011.

United States Design U.S. Appl. No. 29/958,022, filed Aug. 16, 2024, entitled "Auto-Loom Brunnian Link Forming Loom".

Rainbow Loom®) Twistz Bandz product—with bloopers; http://www.youtube.com/watch?v=DbzS5u8ib-0; Jul. 6, 2011.

Amazon.com—Plastic Trash Can Bag Clip Clamp, review date Feb. 19, 2014, online, http://www.amazon.com/Plastic-Garbage-Rubbish-Trash-Holder/dp/B00E6Q0DQ0/ref=sr.

Bipes, Anne, Loom Knitting Getting Started on the Round Loom, www.loomknitting.com, 2005.

Decision to Institute of Inter Partes Review of U.S. Pat. No. 8,485,565 dated May 20, 2014, Case IPR2014-00218, from the United States Patent and Trademark Office.

Defendants' Preliminary Non-Binding Invalidity Contentions, *Choon's Design LLC* v. *Zenacon, LLC et al*., United State District Court for the Eastern District of Michigan, Case No. 2:13-cv-13568-PJD-RSW, Mar. 7, 2014.

European Search Report for EP Application No. 13840473.6 dated Jul. 3, 2014.

European Search Report for EP Application No. 14177709.4 dated Nov. 18, 2014.

European Search Report for EP Application No. 14184490.2 dated Dec. 23, 2014.

European Search Report for EP Application No. 14184498.5 dated Jan. 26, 2015.

Helmet Strap Quick Release Clip, catalog added date Nov. 10, 2011, online, http://allbrandsofthings.com/index.php?main-page=product-info&cPath=33&products-id=457&zenid=adrmed6610j5gqu9dlhqpqgmm7.

How To: Make the Rainbow Loom Single Band Bracelet; Published Aug. 12, 2013 http://www.youtube.com/watch?v=Wd3UdqPmKbA.

How to Make Rubber Band Bracelets Using Twistz Bandz-Instruction #1; http://www.youtube.com/watch?v=6nInnVEjrLU; Mar. 28, 2011.

(56) References Cited

OTHER PUBLICATIONS

How to Make a Homemade Geoboard, http://www.feelslikehomeblog.com/2010/02/how-to-make-a-geoboard/, Feb. 21, 2010.
How to make a fishtail rainbow loom bracelet; http://www.youtube.com/watch?v=ukv83Cvq3jk; Jul. 13, 2013.
How to make a rainbow loom starburst bracelet; Published Aug, 1, 2013 http://www.youtube.com/watch?v=RI7Ak15dJzo.
How to make "Diamond" pattern rubber band bracelet using the Rainbow Loom® Kit; http://www.youtube.com/watch?v=dZa8dpZasKA; Jun. 8, 2011.
International Preliminary Report on Patentability for International Application No. PCT/US2011/041553 mailed on May 16, 2013.
International Preliminary Report on Patentability for International Application No. PCT/US2013/060890 mailed Apr. 9, 2015.
International Preliminary Report on Patentability for International Application No. PCT/US2014/046106 mailed Jan. 28, 2016.
International Search Report & Written Opinion for International Application No. PCT/US2011/041553 mailed on Feb. 23, 2012.
International Search Report and Written Opinion for International Application No. PCT/US14/46106 mailed Oct. 28, 2014.
International Search Report and Written Opinion for International Application No. PCT/US14/54475 mailed Oct. 27, 2014.
International Search Report and Written Opinion for International Application No. PCT/US14/54492 mailed Jan. 5, 2015.
International Search Report and Written Opinion for International Application No. PCT/US2013/060890 mailed Jan. 2, 2014.
International Search Report and Written Opinion for International Application No. PCT/US2015/026280 mailed Jul. 14, 2015.
Introduction video—Rainbow Loom (the next generation Twistz Bandz kit). Published Sep. 24, 2012. http://www.youtube.com/watch?v=FUwf3CheGuw.
Lesson 21:"Sweet Heart" Rainbow Loom Bracelet by Choon; Published Jan. 21, 2013 http://www.youtube.com/watch?v=718MbYceEC0.
Lijovich, Basic Instructions for Using a Double Lucet, Jan. 2002, revised Jun. 2002.
Norris, Kathy, I Can't Believe I'm Loom Knitting!, www.leisurearts.com, 2010.
Petition for Inter Partes Review of U.S. Pat. No. 8,485,565 and Exhibits, filed in the United States Patent and Trademark Office on Aug. 20, 2014, Case No. IPR2014-01353.
Petition for Post-Grant Review of U.S. Pat. No. 8,684,420 and Exhibits, filed in the United States Patent and Trademark Office on Aug. 5, 2014, Case No. PGR2014-00008.
Petitioner's Request for Rehearing Under 37 CFR §42.71(d) filed on Jun. 3, 2014, Case IPR2014-00218, from the United States Patent and Trademark Office.
Phelps, Isela G., Loom Knitting Basics: Knitting in the Round, www.dalooms.com, 2001.
Phelps, Isela, Loom Knitting Primer: A Beginner's Guide to Knitting on a Loom with Over 30 Fun Projects, 2007, pp. 12-20, 99, and 118.
Rainbow Loom from Choon's Design, LLC; Published Jul. 24, 2013 http://www.youtube.com/watch?v=vhiVxnbE0CE.
Takacas, Sarah (SarahLynnTea), How to Make Rubber Band Bracelets; Published Apr. 15, 2009 http://www.youtube.com/watch?v=e0k762PJ-D8.
United Kingdom Combined Search and Examination Report for Application No. GB1416090.7 dated Oct. 16, 2014.
Various rubber band crafts and bracelets using Rainbow Loom®; http://www.youtube.com/watch?v=oM6sOkZFz5o; Mar. 30, 2011.
U.S. Appl. No. 13/938,717, filed Jul. 10, 2013, entitled "Brunnian Link Making Device and Kit".
U.S. Appl. No. 14/329,099, filed Jul. 11, 2014, entitled "Brunnian Link Making Device and Kit".
U.S. Appl. No. 13/626,057, filed Sep. 25, 2012, entitled "Brunnian Link Making Device and Kit".
Design U.S. Appl. No. 29/468,549, filed Oct. 1, 2013, entitled "Brunnian Link Forming Loom".
Design U.S. Appl. No. 29/468,891, filed Oct. 24, 2013, entitled "Brunnian Link Forming Loom".
U.S. Appl. No. 14/226,096, filed Mar. 26, 2014, entitled "Monster Tail Loom for Forming Brunnian Links".
U.S. Appl. No. 14/270,635, filed May 6, 2014, entitled "Device for Forming Brunnian Links".
International Preliminary Report on Patentability for International Application No. PCT/US2014/054492 mailed Mar. 24, 2016.
Rainbow Loom, Rainbow Loom Neon Jumbo Bucket with 2X Happy Loom (B0327), (first available Feb. 10, 2021), Amazon.com, URL: <https://www.amazon.com/Rainbow-Loom-Jumbo-Bucket-B0327/dp/B08WDN7LYL> (Year: 2021).
Petition for Inter Partes Review of U.S. Pat. No. 8,485,565 and Exhibits, filed in the United States Patent and Trademark Office on Mar. 3, 2015, Case No. IPR2015-00838.
Extended European Search Report for European Application No. 25175203.6 mailed Feb. 5, 2026.

* cited by examiner

AUTOLOOM

BACKGROUND

An item formed from elastic bands may be formed by hand or utilizing a device with a set of fixed pins. Elastic bands are biased toward a relaxed position and therefore devices that hold the bands in a stretched condition may be utilized and enable formation of more complex linked articles. Even with a device to hold elastic bands in place, some dexterity is required to form complex linked articles. The level of dexterity required to form complex linked articles may limit efforts for some individuals in the elastic band linked article craft.

SUMMARY

A kit for forming an item from closed loop elastic bands according to a disclosed example embodiment includes, among other things, a plurality of closed loop elastic bands, and a device having a guide including at least two poles spaced apart from each other, the two poles including an outward extending flange configured to hold at least one closed loop elastic band therebetween and a slider having at least two arms movable relative to the at least two poles. Each of the at least two the arms including a finger portion having a hook and a push surface, the hook configured to pick a lowermost elastic band supported on a corresponding one of each of the at least two poles and the push surface configured to push an elastic band over the outwardly extending flange.

A device for forming an item from closed loop elastic bands according to another disclosed example embodiment includes, among other possible things a guide having at least two poles spaced apart from each other, the two poles are configured to hold at least one closed loop elastic band therebetween, and a slider having at least two arms movable relative to the at least two poles. Each of the at least two the arms include an end with a finger portion having a hook and a push surface, the hook configured to pick a lowermost elastic band supported on each of the at least two poles and the push surface is configured to push an elastic band off of the corresponding one of the at least two poles.

A method of forming a Brunnian link using a closed loop elastic band according to another example disclosed embodiment includes, among other possible things, the steps of placing at least two closed loop elastic bands across at least two poles, moving one arm of at least two arms relative to each of the at least two poles to generate outward movement of each arm relative to the at least two poles, picking one of the at least two closed loops off the at least two poles with the at least two arms with the outward movement of each arm, extending each of the at least two arms upward and outward over an outwardly extending flange on each of the at least two poles such that the one closed loop elastic band picked by off the at least two poles slides over the outwardly extending flange, retracting the arms downwardly back past the outwardly extending flange to release the picked one closed loop elastic band from the at least two arms and links to the other of the at least two closed loop elastic bands remaining on the at least two poles, and repeating the above steps with at least one additional closed loop elastic band to create additional links.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
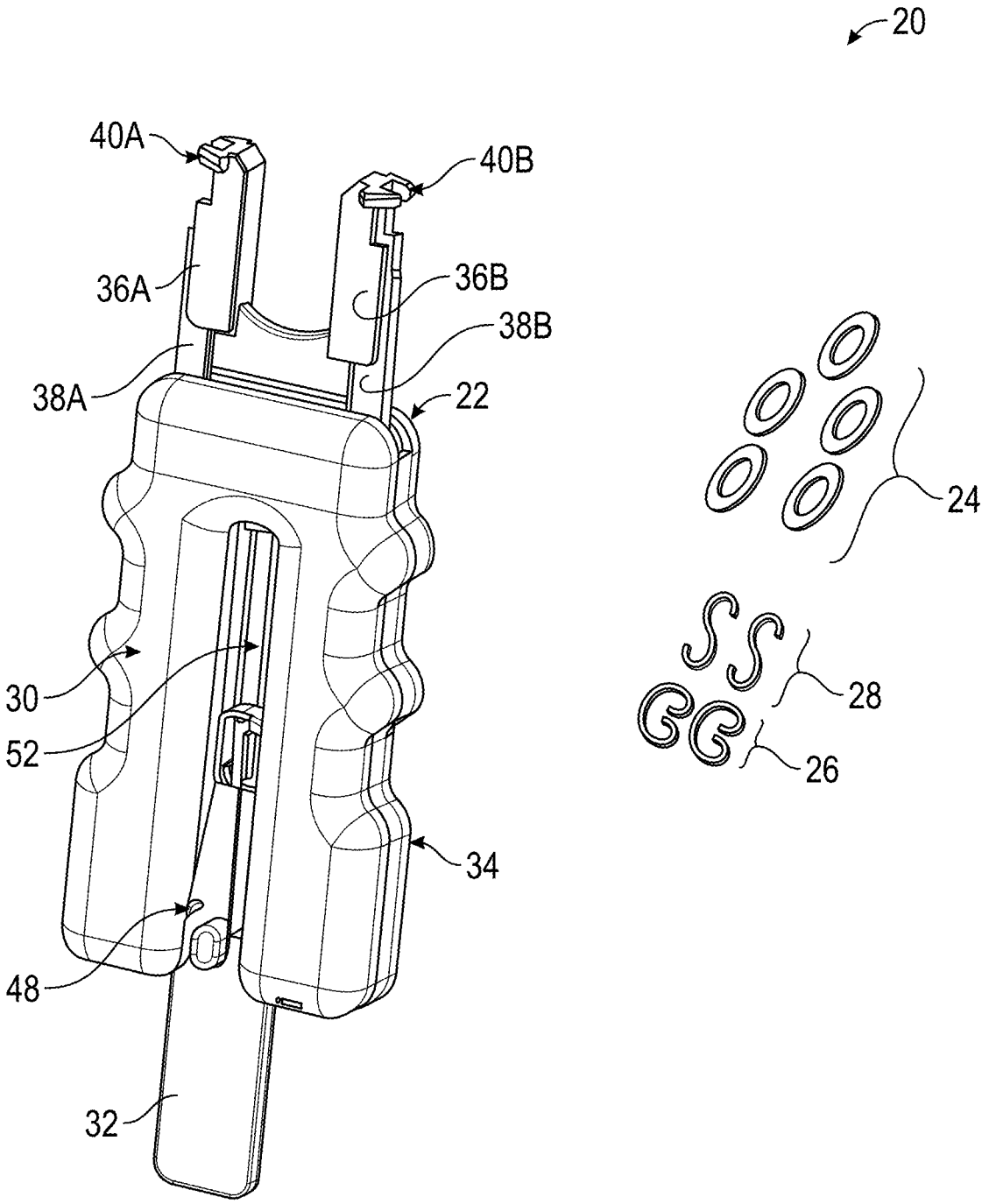
FIG. 1 is a schematic view of an example kit for creating linked articles from elastic bands.

FIG. 1 schematically illustrates a kit 20 for forming a linked article from closed loop elastic bands. The kit 20 includes an autoloom 22, elastic bands 24, and clips 26, 28. The autoloom 22 provides an easy repeatable means of creating linked items from closed loop elastic bands 24. The autoloom 22 provides for the automatic picking and linking of elastic bands to simplify and speed up the creation of linked items.

The clips 26, 28 may be of any shape that provides for the securement of loose ends of the elastic bands 24. For example, the clips 26 are generally C-shaped and the clips 28 are generally S-shaped. Both the C-shaped clips 26 and the S-shaped clips 28 include features for holding ends of an article formed from closed loop elastic bands. The elastic bands 24 are used to form a series of links that form a linked article. The autoloom 22 supports elastic bands to provide for creation of links with simple repeatable steps.

In one disclosed example, the links are formed as a series of Brunnian links. A Brunnian link is formed between two continuous closed looped structures such as the example elastic bands 24 without forming an actual knot. Each link is formed by capturing ends of one elastic band 24 with a mid-portion of another elastic band 24. Each link depends on the previous and subsequent links to maintain a desired linked article. The autoloom 22 provides for the creation of Brunnian links in a quick, efficient, and repeatable manner.

The example autoloom 22 includes a slider 32 that is disposed within a guide 30 and a cover 34. The cover 34 attached to the guide 30 and defines a space within which the slider 32 moves. The guide 22 includes a first post 36A spaced apart from a second post 36B. The first post 36A includes a first flange 40A. The second post 36B includes a second flange 40B. The flanges 40A-B extend outward from each corresponding post 36A-B. The flanges 40A-B prevent the errant release of elastic bands that are stretched between the posts 36A-B. The slider 32 includes a first arm 38A and a second arm 38B. The first and second arms 38A-B are moved relative to a corresponding one of the posts 36A-B to lift an elastic band from the posts 36A-B and around the corresponding one of the flanges 40A-B. Upward and outward movement of the arms 38A-B is defined to grasp and release an elastic band to form a link with other elastic bands supported across the posts 36A-B.

Figure 2:
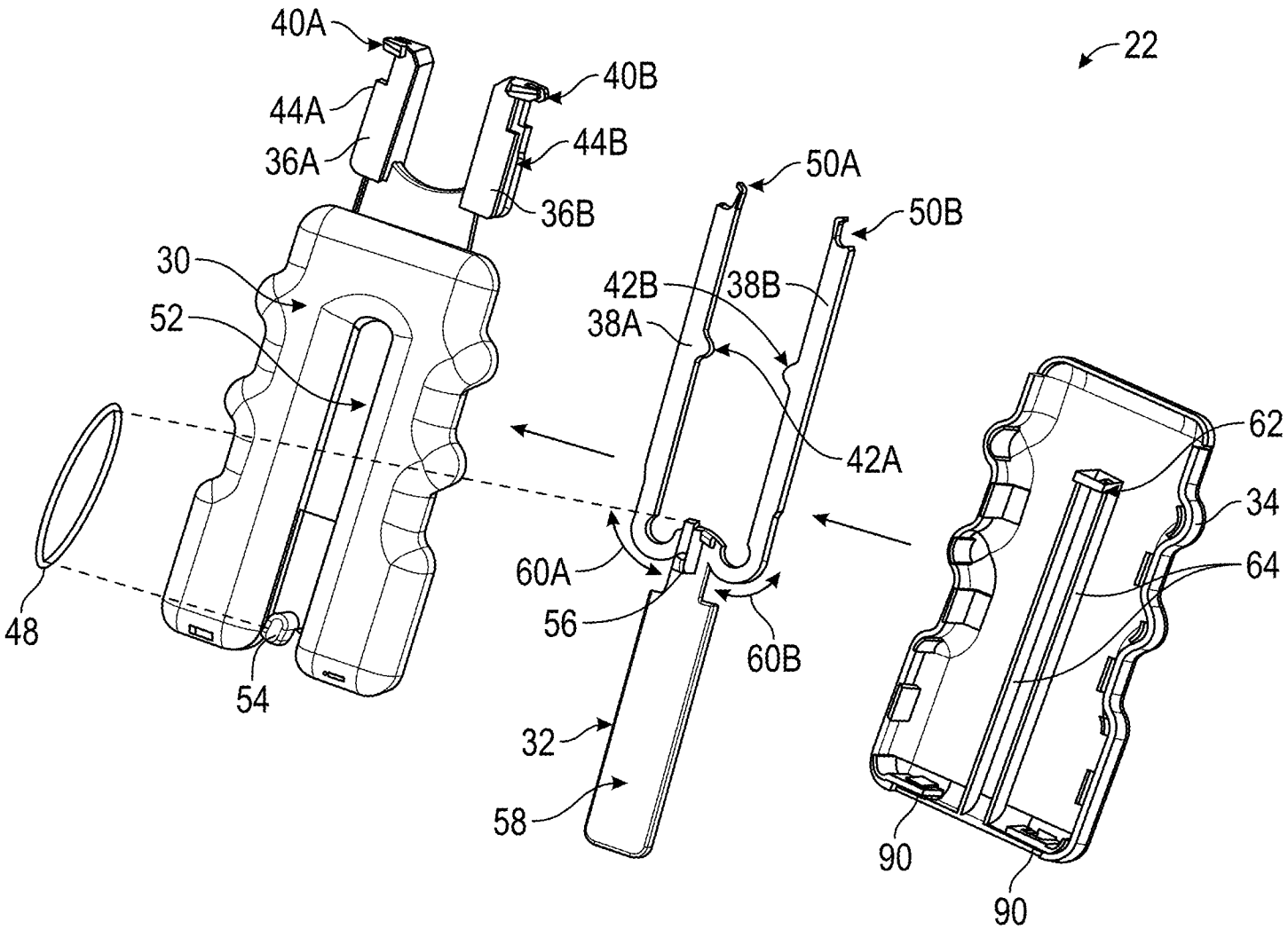
FIG. 2 is an exploded view of an example autoloom embodiment.

Referring to FIG. 2, with continued reference to FIG. 1, the parts of the autoloom 22 are shown in an exploded view. The slider 32 fits within a space defined between the guide 30 and the cover 34. The guide 30 includes the posts 36A-B with flanges 40A-B. A first guide groove 44A extends through the first post 36A and the first flange 40A. A second guide groove 44B extends through the second post 36B and the second flange 40B. The corresponding first and second arms 38A-B fit and move within the corresponding guide groove 44A-B.

The first arm 38A includes a first finger 50A. The second arm 38B includes a second finger 50B. The first and second fingers 50A, 50B are disposed at ends of the corresponding arms 38A-B and are shaped to grasp a lower-most elastic band from a corresponding one of the posts 36A-B.

The slider includes a guide tab 56 and the guide 30 includes a bias hook 54. A biasing member 48 is attached across the guide tab 56 and the bias hook 54 to bias and hold the slider 32 in an initial position as shown in FIG. 1. In the initial position, the slider 32 is biased downwardly such that an actuation tab 58 extends from the guide 30 and cover 34. In use, the actuation tab 58 is used to move the slider 32 upwardly relative to the guide 30. The guide tab 56 moves within an opening 52 that is defined within the guide 30. The cover 34 includes a stop 62 and guide ribs 64 that correspond with the opening 52 and the guide tab 36 to aid in guiding and maintaining a desired relative position between the slider 32 and the guide 30 during use.

Figure 3:
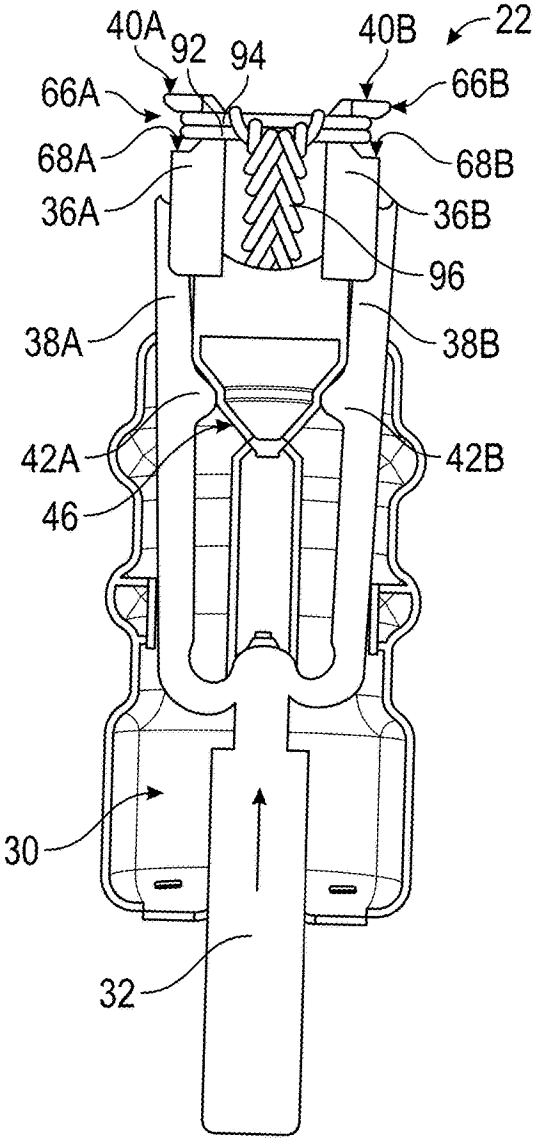
FIG. 3 is a view of inner features of the example autoloom in a first condition.

Referring to FIG. 3, with continued reference to FIG. 2, the slider 32 is shown within the guide 30 with the cover 34 removed. First and second elastic bands 92, 94 are held across the posts 36A-B. In the illustrated example, the first elastic band 92 is disposed below the second elastic band 94 and a series of previously formed links 96 is supported between the posts 36A-B. The specific function of how the links 96 are formed will be described in detail once the structures of the autoloom 22 are descried.

Movement of the arms 38A-B is precisely defined to pick only one of the elastic bands 92, 94 from the posts 36A-B. Specifically, the lower-most band 92 is picked from the posts 36A-B as will be explained below. The defined movement is provided by an interaction between first and second lobes 42A-B on each arm 38A-B and a cam surface 46 defined by the guide 30. Upward movement of the slider 32 drives the lobes 42A-B along the cam surface 46 such that the arms 38A-B expand outward at a desired precise position relative to the posts 36A-B.

The first post 36A includes a first band retention area 66A and the second post 36B includes a second band retention area 66B. Each band retention area 66A, 66B includes a corresponding one of a first and second bottom edge 68A, 68B. The finger 50A, 50B of each of the arms 38A-B moves outwardly relative to the respective bottom edge 68A, 68B in response to upward movement of the slider 32. The lobes 42A-B guide along the cam surface 46 to cause outward movement of each of the arms 38A-B, and thereby the corresponding fingers 50A, 50B. The outward movement of the arms 38A-B is defined relative to the bottom edges 68A, 68B and the flanges 40A-B.

In the disclosed example, movement of the arms 38A-B is initially outward to pick the lower-most elastic band from the band retaining area 66A, 66B. The arms 38A-B than move inwardly in response to further upward movement. Movement is defined along the cam surface 46. The example cam surface 46 is a continuous surface that extends upwardly to merge with a bottom surface of the guide grooves 44A-B (FIG. 2) within the posts 36A-B.

Figure 4:
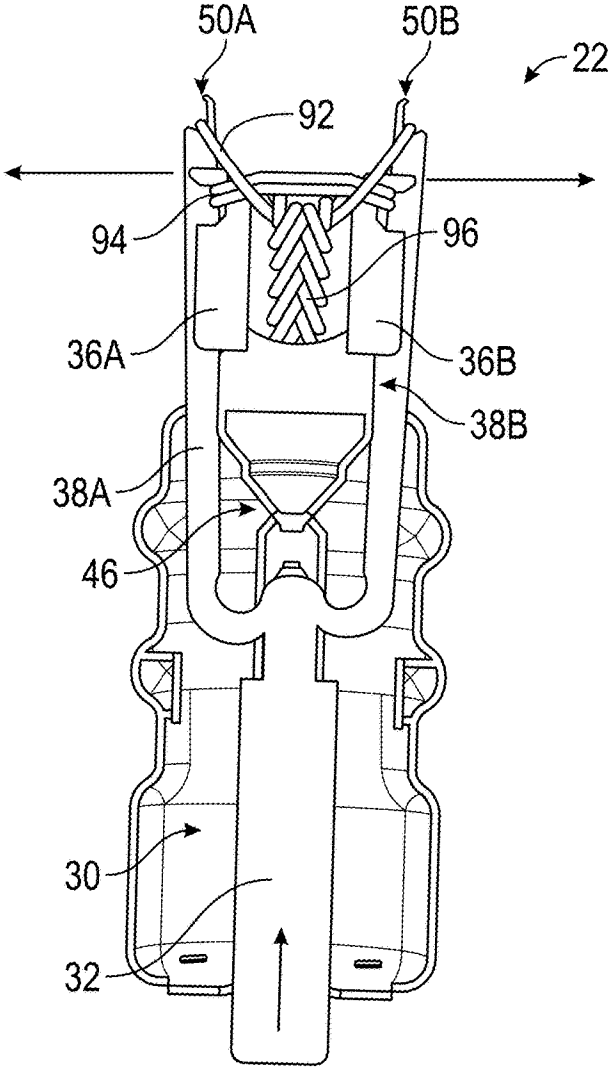
FIG. 4 is another view of inner features of the example autoloom in a second position.

Referring to FIG. 4, with continued reference to FIG. 3, the slider is shown in an upper position where the fingers 50A, 50B have grasped the elastic band 92 and moved past the flanges 40A, 40B. The arms 36A-B have also moved outwardly relative to the flanges 40A-B. The other elastic band 94 and the linked item 96 remain on the posts 36A-B. Only the lower most elastic band 92 was lifted off the posts 36A-B.

Release of the upward force on the slider 32 allows the biasing member to move the slider downwardly. Downward movement of slider 32 causes the elastic band 92 to be released from the fingers 50A, 50B and from the flanges 40A-B such that it becomes part of the linked item 96. Additional elastic bands are assembled across the posts 36A-B and the process repeated until a desired length and structure of the linked item is obtained.

Figure 6:
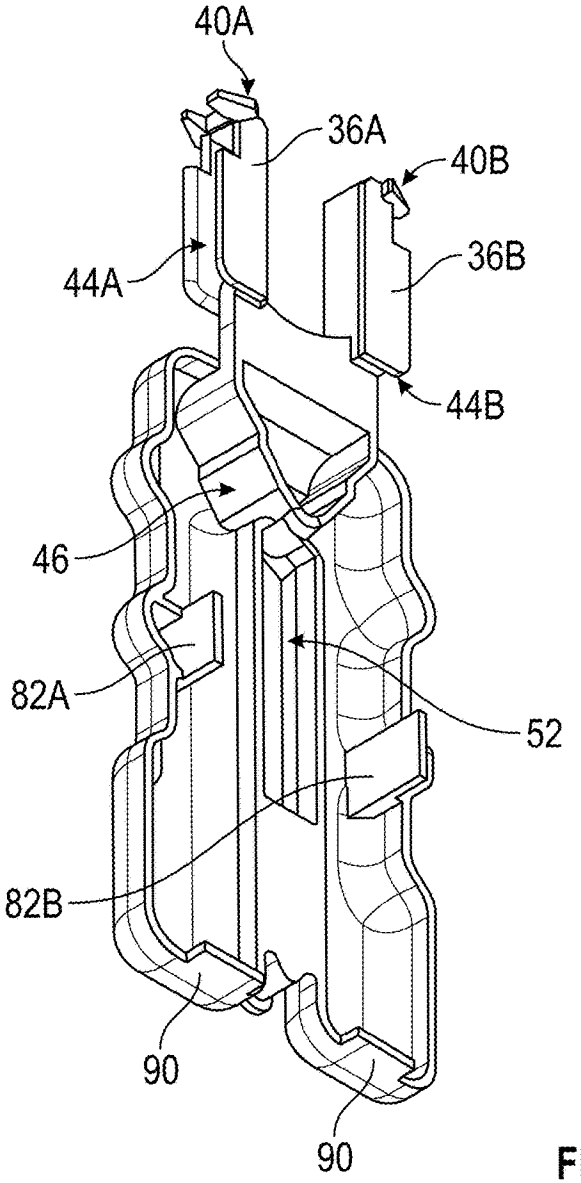
FIG. 6 is a perspective view of the guide.
Figure 5:
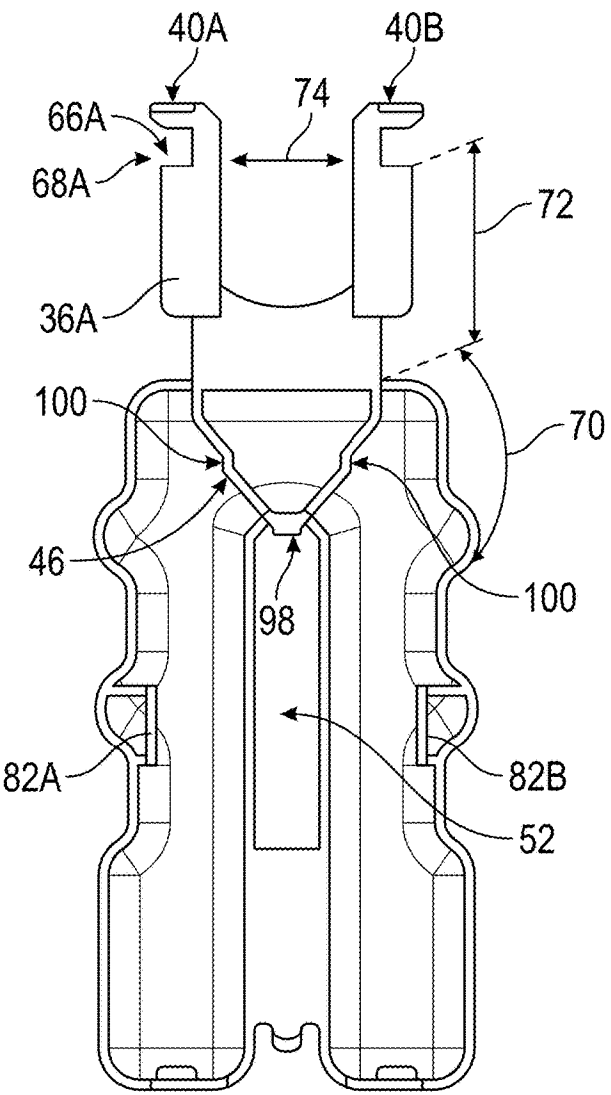
FIG. 5 is a plan view of a guide of the example autoloom.
Figure 7:
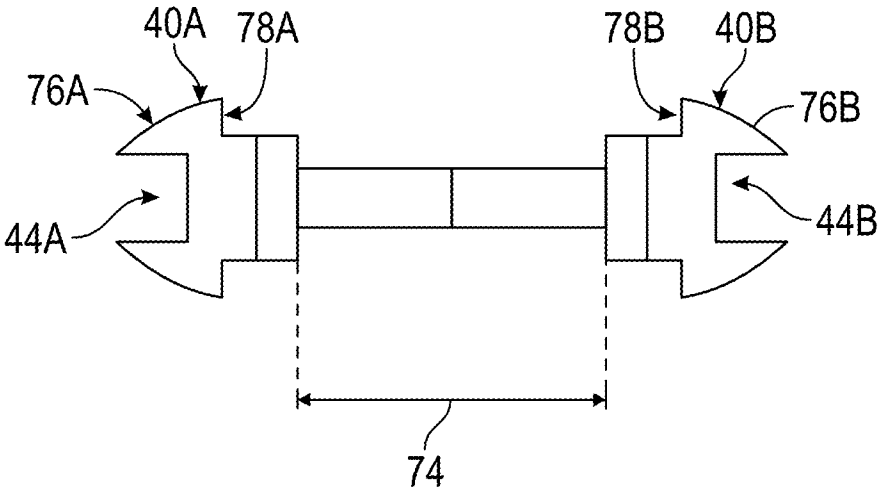
FIG. 7 is a top view of flanges of the guide.

Referring to FIGS. 5, 6 and 7 with continued reference to FIGS. 3 and 4, the example guide 30 is a single integral part with features for supporting elastic bands and defining movement of the arms 38A-B. The guide 30 includes the posts 36A-B that are spaced a distance 74 apart. The distance 74 is sized relative to a size of elastic band used in forming the linked item.

The cam surface 46 extends from a bottom point 98 through an expansion portion 70 to a retraction portion 72. A nesting point 100 is provides where the lobes 42A-B set when the slider 32 is in an initial position. The cam surface 46 expands outwardly in the expansion portion 70 to drive the arms 38A-B outward. The expansion portion 70 extends from the nesting point 100 upward to the retraction portion 72. The retraction portion extends from the end of the expansion portion upward into to each of the posts 36A-B. A bottom surface of each of the guide grooves 44A-B is part of the retraction portion 72 of the cam surface 46. The retraction portion 72 provides for inward movement of the arms 38A-B.

Accordingly, the portions of the cam surface 46 define movement of the arms 38A-B relative to the posts 36A-B. In one disclosed example, the interaction between the cam surface 46 and the lobes 42A-B of the arms 38A-B define movement transverse to upward sliding movement.

The flanges 40A-B includes features that prevent errant release of elastic bands, permit lifting off with the fingers 50A, 50B and subsequent release when the fingers 50A, 50B are moved back downward. First and second ramp portions 76A, 76B provide for the elastic bands to slide off in response to upward movement when grasped by the fingers 50A, 50B. First and second straight back surfaces 78A, 78B catch the elastic bands to enable release from the corresponding Finger 50A, 50B with further downward movement. The guide groove 44A-B extends through the flange 40A-B to provide the space form movement of the fingers 50A, 50B through the flange 40A-B.

The guide 30 further includes first and second return surfaces 82A-B, that guide the arms 38A-B of the slider 32 back to the initial position. The return surfaces 82A-B push inward against outer edges of the arms 38A-B to fixe them in the initial, start position.

The guide 30 and the cover 34 snap together with features such as the tabs 90 provided along the bottom of the guide 30. Additional tabs and snap fit structures are arranged about the periphery of the guide 30 and cover 34 to facilitate securement to each other.

Figure 8:
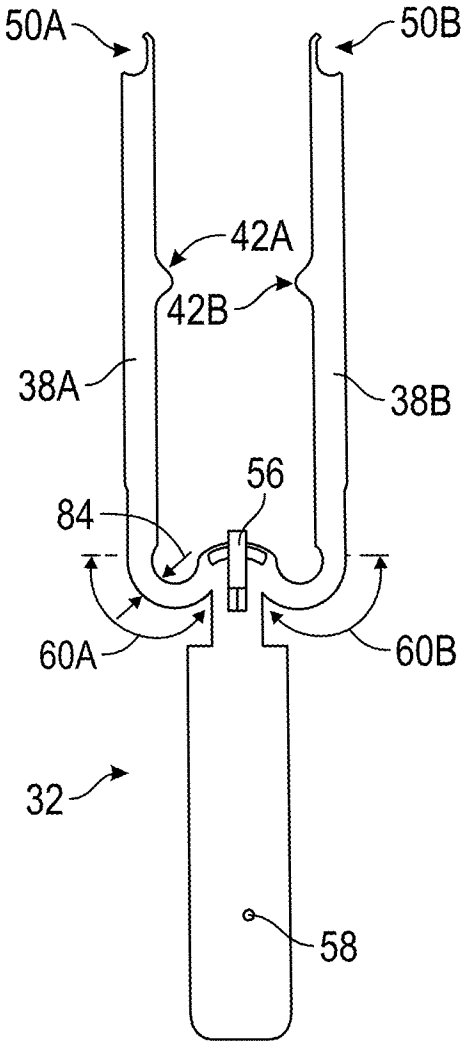
FIG. 8 is a plan view of a slider of the example autoloom.
Figure 9:
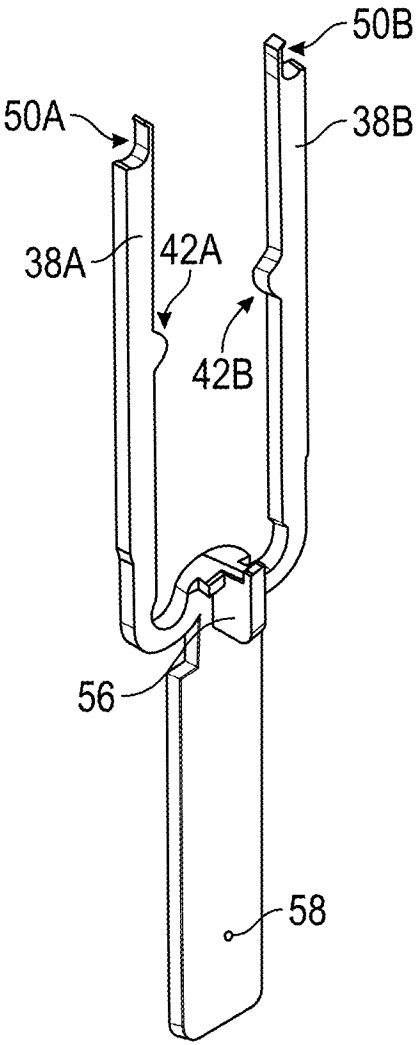
FIG. 9 is a perspective view of the slider.

Referring to FIGS. 8, 9 with continued reference to FIGS. 3 and 4, the slider 32 is shown separate from the guide 30. The slider 32 includes the arms 38A-B that extend from the actuation tab 58. The arms 38A-B includes a spring portion 60A-B that provides both for expansion outward and a return to the default relaxed position shown in FIGS. 8 and 9. A thickness 84 in the spring portions 60A-B is different than along the full length of each arm 38A-B. The thickness 84 is defined to provide flexibility of the arms 38A-B that facilitates outward movement. Moreover, the spring portions 60A-B define the flexible portions of the arms 38A-B such that the remainder of the arms 38A-B remain substantial straight during operation. As appreciated, the elastic bands exert a bias toward a relaxed condition. Stretching of the elastic bands as is performed upon lifting from the corresponding posts 36A-B exerts a force on the arms 38A-B. The arms 38A-B are therefore sized and configured to limit bending, but for in the spring portions 60A-B.

The biasing hook 56 is disposed between the arms 38A-B and engages the biasing member 48 (FIG. 1) utilized to automatically return the slider to the initial start position as shown in FIGS. 1 and 3.

Figure 10:
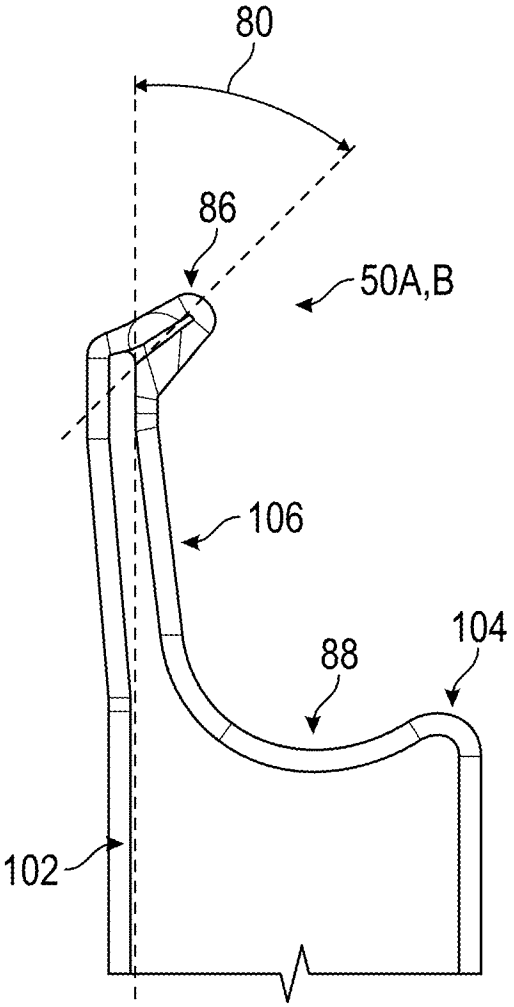
FIG. 10 is an enlarged side view of a finger of the slider.

Referring to FIG. 10, with continued reference to FIGS. 3, 4, 8 and 9, one of the fingers 50A-B is shown enlarged. The example finger 50A-B includes a hook portion 86 that is configured to pick a single elastic band from the post 36A-B. The example hook 86 is disposed at an angle 80 relative to an inner side 102 of each arm 38A-B. The example angle 80 is approximately 45° relative to the inner side 102. The angle 80 is set to correspond with upward and outward movement of the finger 50 relative to the lower edge 66A-B of the retaining space 68A-B on each post 36A-B. The configuration of the finger 50A-B and the hook 86 are set to precisely lift only one of many elastic bands from the posts 36A-B. It should be appreciated that although an angle of 45° is disclosed by way of example, other angles could be utilized and are within the contemplation of this disclosure.

Each finger 50A-B also includes a lift surface 88. The lift surface 88 provides for pushing of a grasped elastic band upward and around the flanges 40A-B. In operation, the elastic band is picked from the post 36A-B by the hook 86. The captured elastic band will ride down along an inner surface 106 onto the lift surface 88. The lift surface 88 includes a small retainer bump 104 that aids in preventing the elastic band from riding entirely off the lift surface 88. Tension exerted by the elastic band will hold the elastic band against inner surface 106 until upward movement pushes the elastic band onto the lift surface 88. The bump 104 assures that the elastic band remains in place but is not so great of an obstruction to prevent release from the finger 50A-B when required.

FIGS. 11-28 illustrate an example sequence of operation of the autoloom 22 to pick and release an elastic band from posts 38A-B to form a link. Operation begins by loading elastic bands across the posts 36A-B. In one example, a first band is stretched across the posts 36A-B and twisted to form an X-shape. At least one additional band is then assembled stacked above the first elastic band. Additional elastic bands may be added along with the first two elastic bands. In the example disclosed operation, three elastic bands are shown. Two elastic bands, or more than three elastic bands could be utilized depending on the desired link configuration. The example operation is described below beginning once the elastic bands are loaded to the posts 36A-B.

Figure 12:
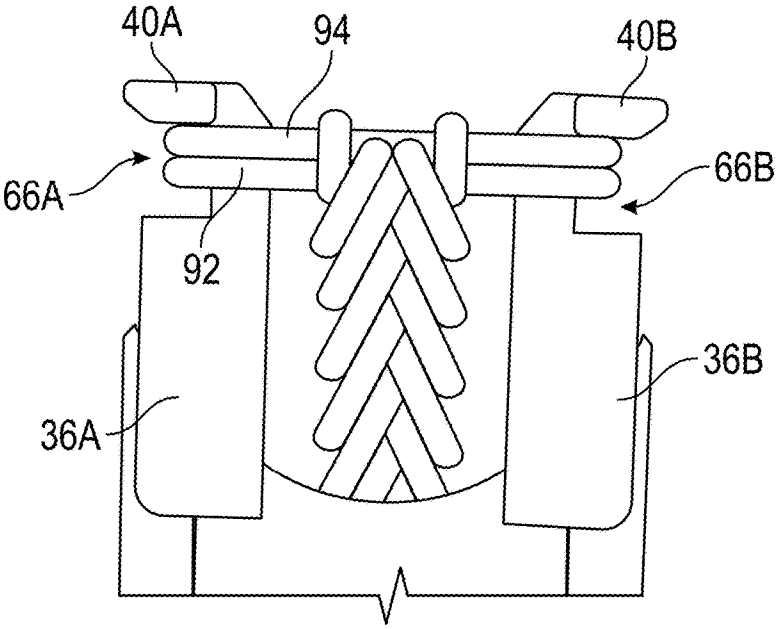
FIG. 12 is an enlarged view of the autoloom in the initial position.
Figure 11:
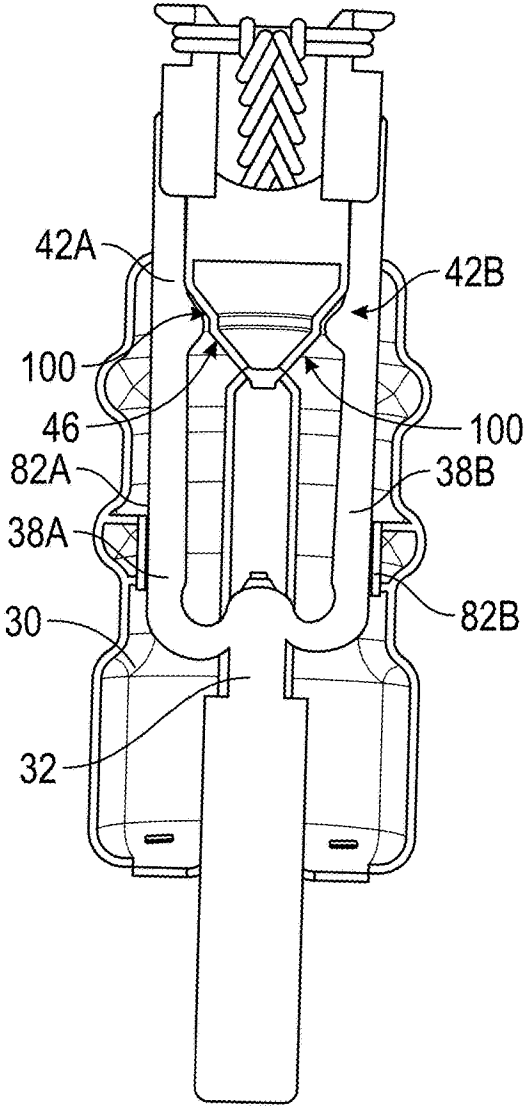
FIG. 11 is a view of the autoloom in an initial position.

Referring to FIGS. 11 and 12, operation of the autoloom 22 begins with the slider 32 in an initial position. In the initial position, the lobes 42A-B of the slider 32 are set in the nesting point 100. The arms 38A-B are fully set inward against the returns 82A-B. Elastic bands 92 and 94 are set on the posts 36A-B in the retention areas 66A-B below each of the flanges 40A-B.

Figure 15:
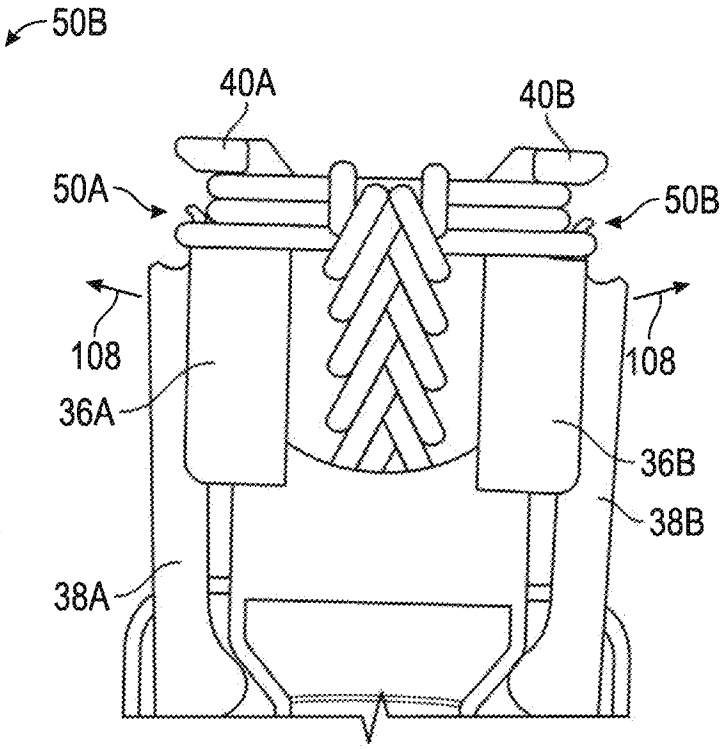
FIG. 15 is an enlarged view of the autoloom in the position to pick the first elastic band.
Figure 14:
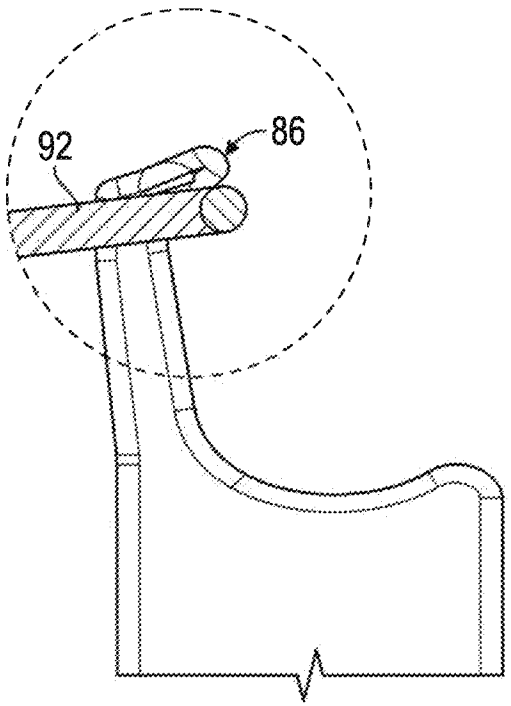
FIG. 14 is an enlarged view of a finger portion in the position to pick the first elastic band.
Figure 13:
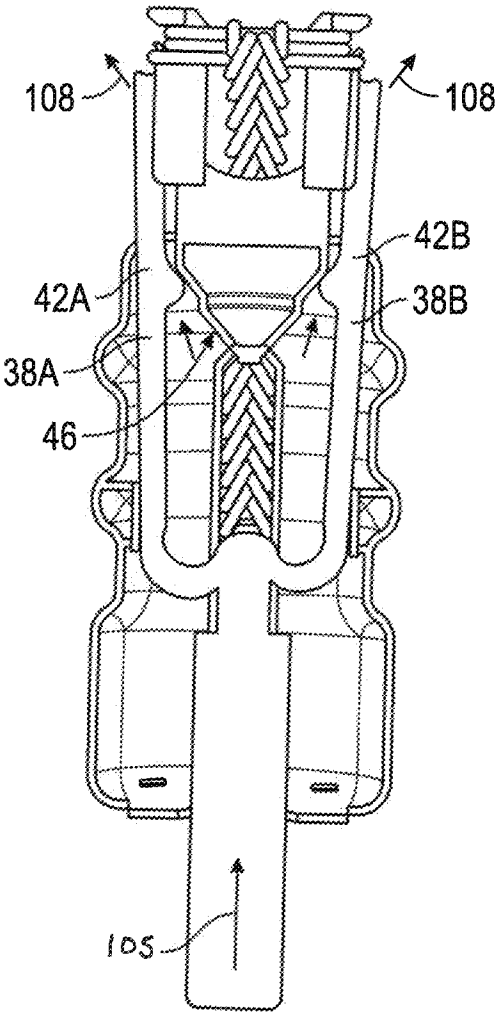
FIG. 13 is a view of the autoloom in a position to pick a first elastic band.

Referring to FIGS. 13, 14 and 15, upon initial engagement of a force in the direction shown by arrow 105, the lobes 42A-B are moved along the cam surface 46 and expand outwardly such that the fingers 50A-B engage the lowermost elastic band 92. As the arms 38A-B are driven upward and outward, the hook 86 of each finger 50A-B picks and begins pulling the elastic band 92 outwardly as indicated by arrows 108.

Figure 17:
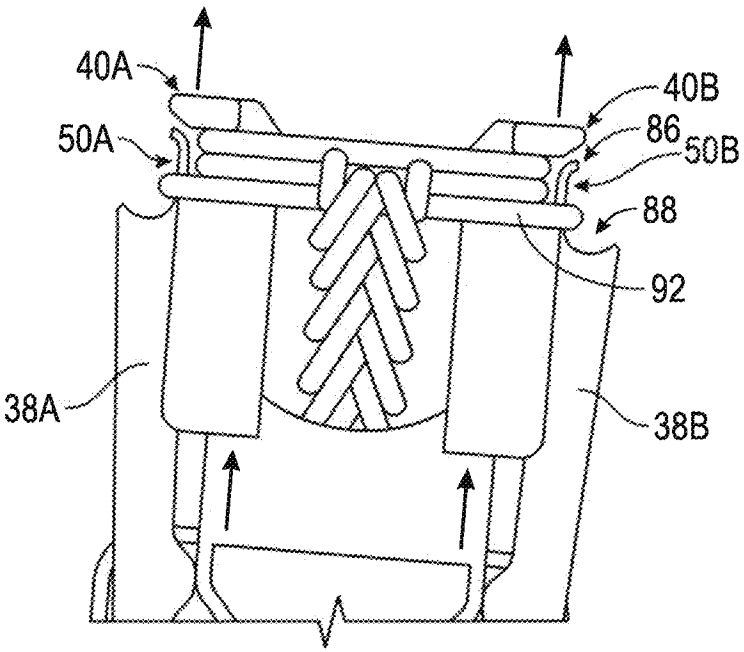
FIG. 17 is an enlarged view of the autoloom in the position that expands the picked elastic band.
Figure 16:
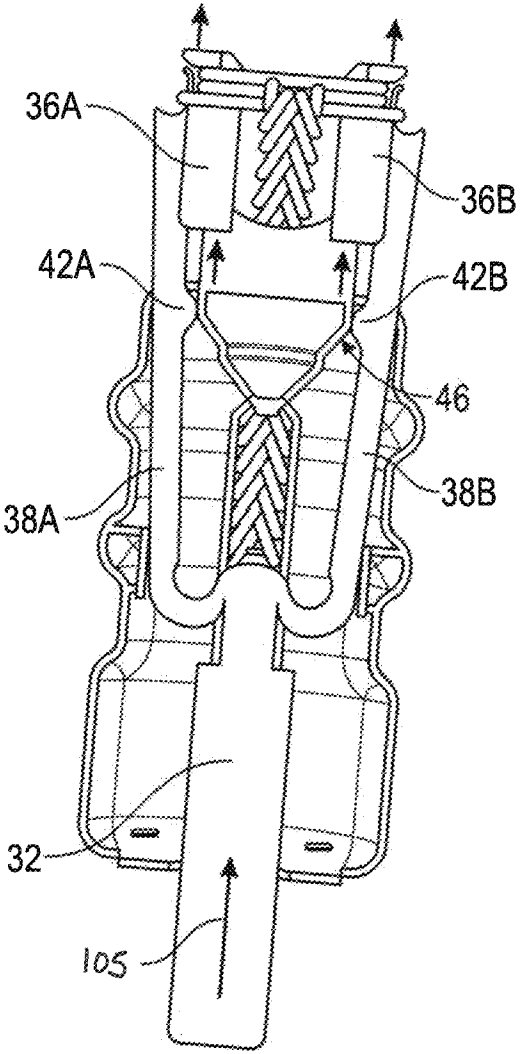
FIG. 16 is a view of the autoloom in a position that expands the picked elastic band.

Referring to FIGS. 16 and 17, the fingers 50A-B are shown expanded further outward with the elastic band 92. The fingers 50A-B are also moving upward as a result of the pushing force exerted on the slider 32 in the direction indicated by arrow 105. The outward movement of the arms 38A-B is generated by the interface between the lobes 42A-B and the cam surface 46. The elastic band 92 has slide downward from the hook 86 toward the lift surface 88.

Figure 18:
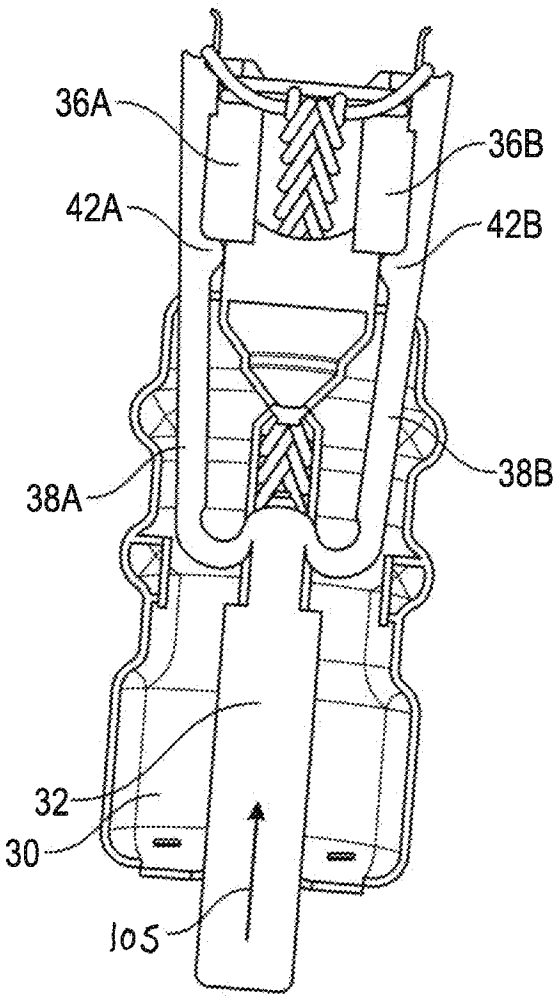
FIG. 18 is a view of the autoloom in a position moving the elastic band over a flange.
Figure 19:
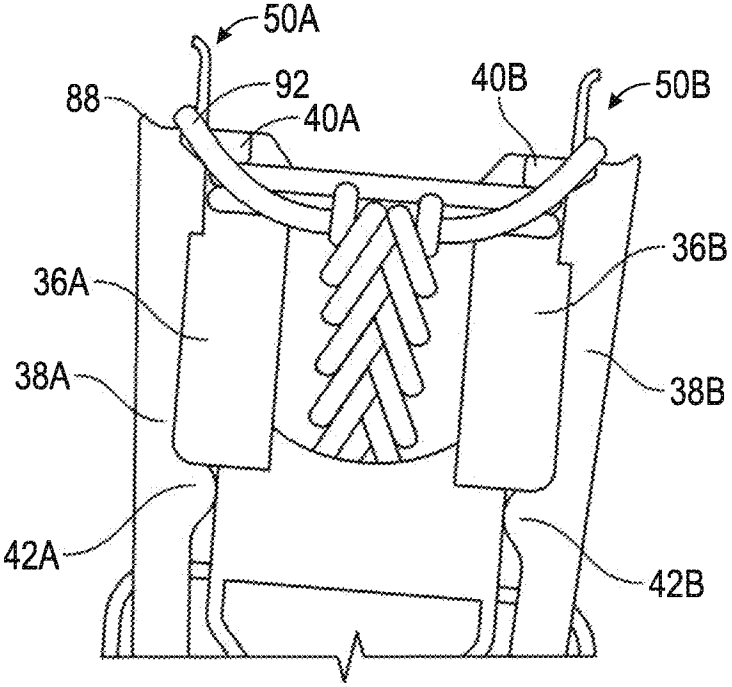
FIG. 19 is an enlarged view of the autoloom in the position to move the elastic band over the flange.
Figure 20:
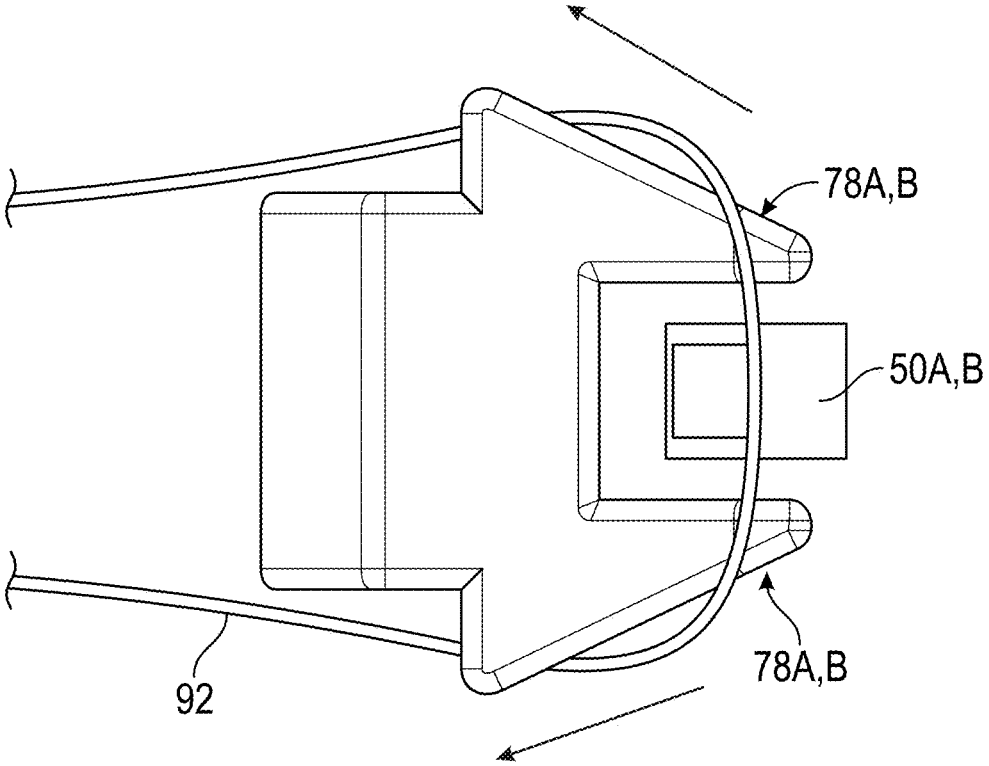
FIG. 20 is a top view of the flange where the autoloom is in the position to move the elastic band over the flange.
Figure 22:
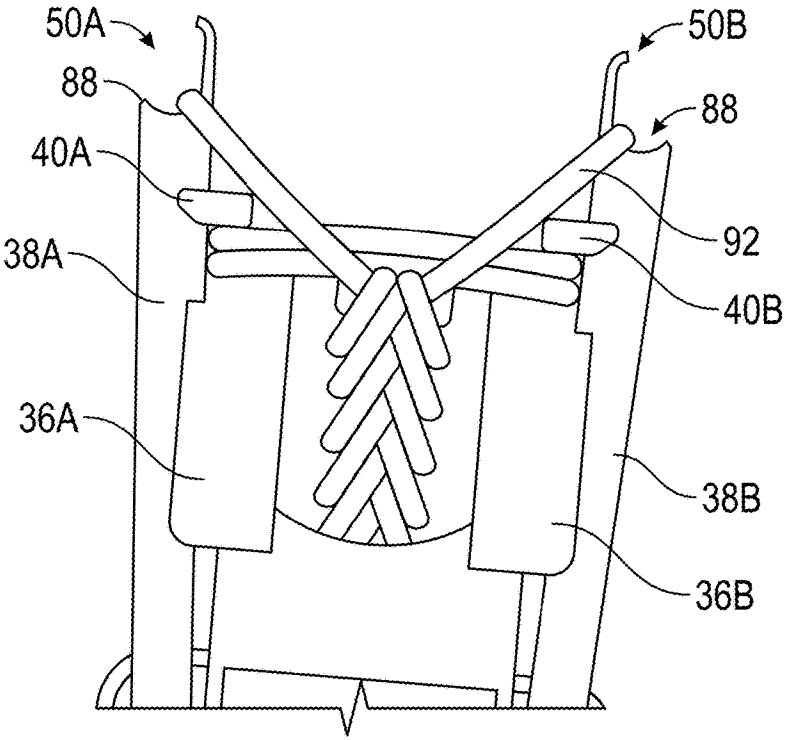
FIG. 22 is an enlarged view of the autoloom with the elastic band released from the flange.
Figure 21:
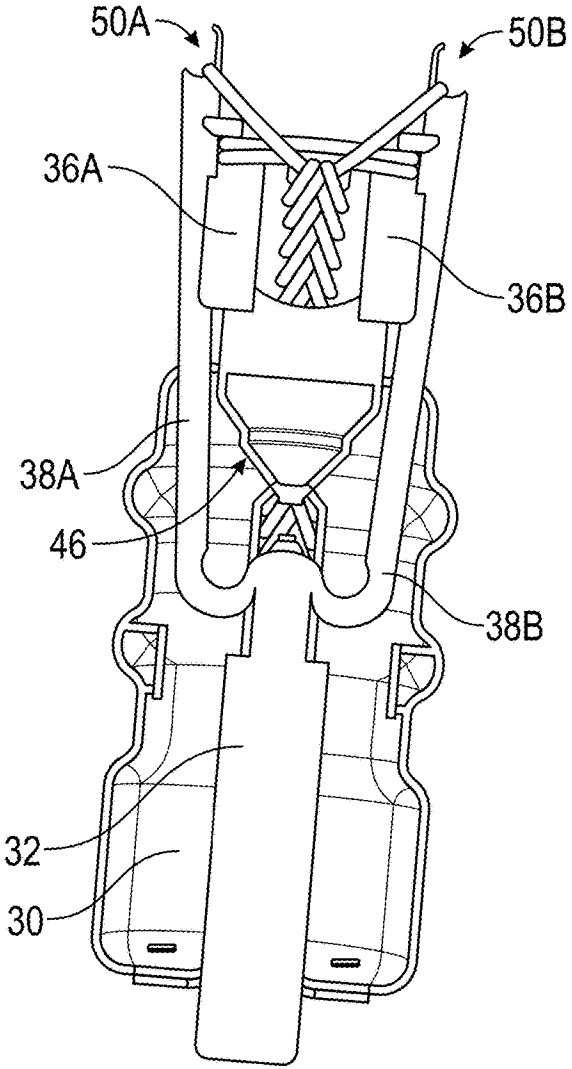
FIG. 21 is a view of the autoloom where the elastic band is released from the flange.
Figure 23:
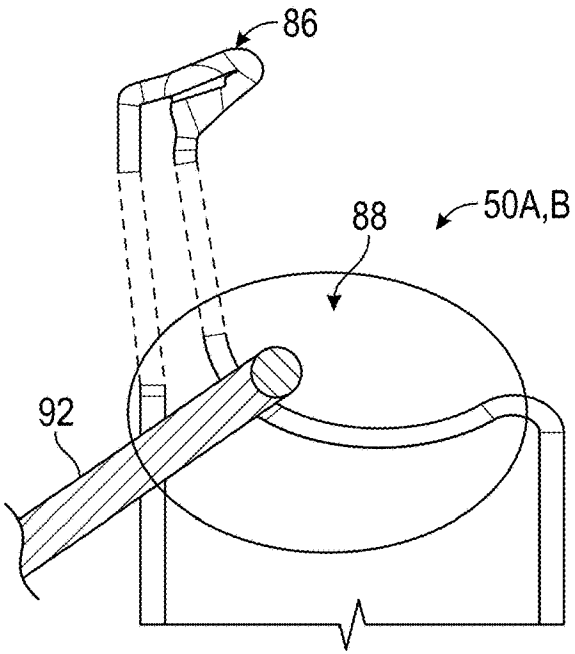
FIG. 23 is a view of a finger and elastic band with the autoloom in the position shown in FIGS. 21 and 22.

Referring to FIGS. 18, 19 and 20, further upward movement of the slider 32 as indicated by arrow 105 moves the fingers 50A-B upward past respective flanges 40A-B. The elastic band 92 is fully seated on the lift surface 88 and pushed upward over the flanges 40A-B. The upward push drives the elastic band 92 along ramp surfaces 76A-B of each flange 40A-B. The ramp surfaces 76A-B allow the elastic band 92 to slide over and around the corresponding flange 40A-B. The lobes 42A-B are moves upward further along the cam surface 46 toward the retraction portion 72 corresponding to the guide grooves 44A-B (Best shown in FIG. 5). ease amend the claims as follows:

Referring to FIGS. 21, 22 and 23, the elastic band 92 is pulled free of the corresponding flange 40A-B. At this point, the slider 32 is near the upward limit and may being moving back downward toward the initial position. The arms 38A-B move back inwardly enough to facilitate release of the elastic band 92.

Figure 25:
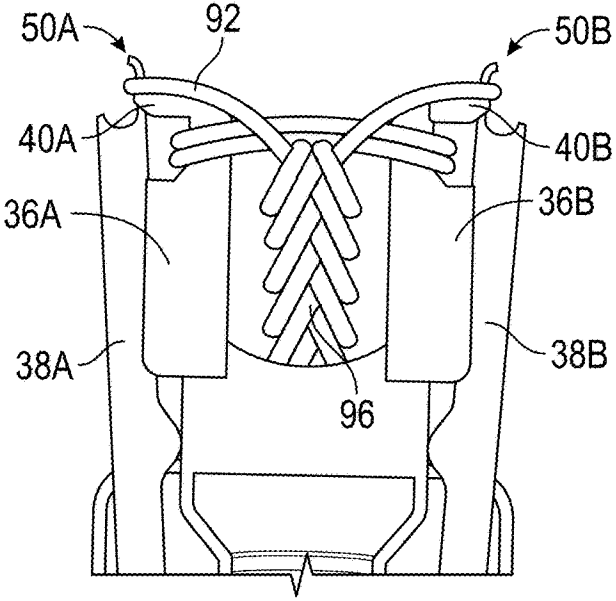
FIG. 25 is an enlarged view of the autoloom in the position shown in FIG. 24.
Figure 24:
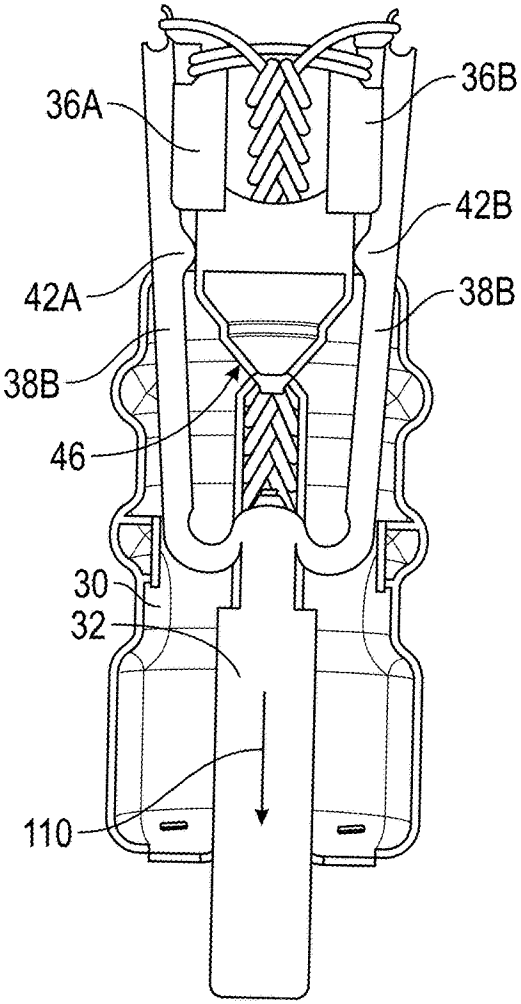
FIG. 24 is a view of the autoloom in a position where the elastic band is ready for release from a finger.
Figure 26:
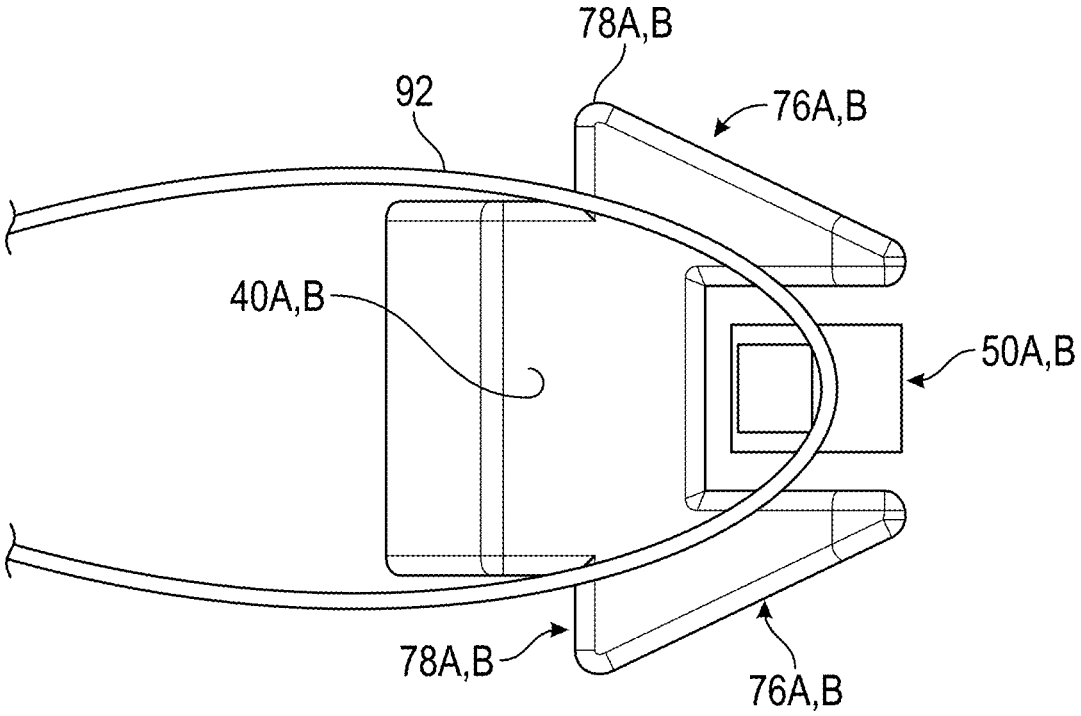
FIG. 26 is a top view of a flange with the autoloom and elastic band in the position shown in FIGS. 24 and 25.

Referring to FIGS. 24, 25 and 26, continued retracting downward movement of the slider 32 results in engagement of the elastic band 92 with a back surface 78A-B of each flange 40A-B. The back surface 78A-B is a straight part that hooks the elastic band 92 as the finger 50A-B moves downward past the flange 40A-B. Trapping of the elastic band 92 provides for release from the finger 50A-B. Because the elastic band 92 had been previously released from the flange 40A-B, the subsequent release from the finger 50A-B frees the elastic band to become part of the linked article 96.

Figure 28:
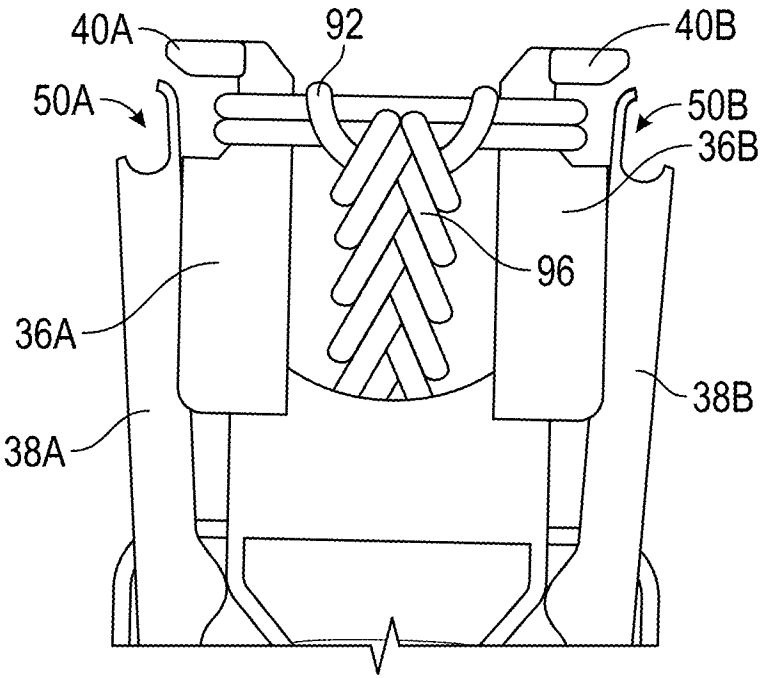
FIG. 28 is an enlarged view of the autoloom in the position shown in FIG. 27.
Figure 27:
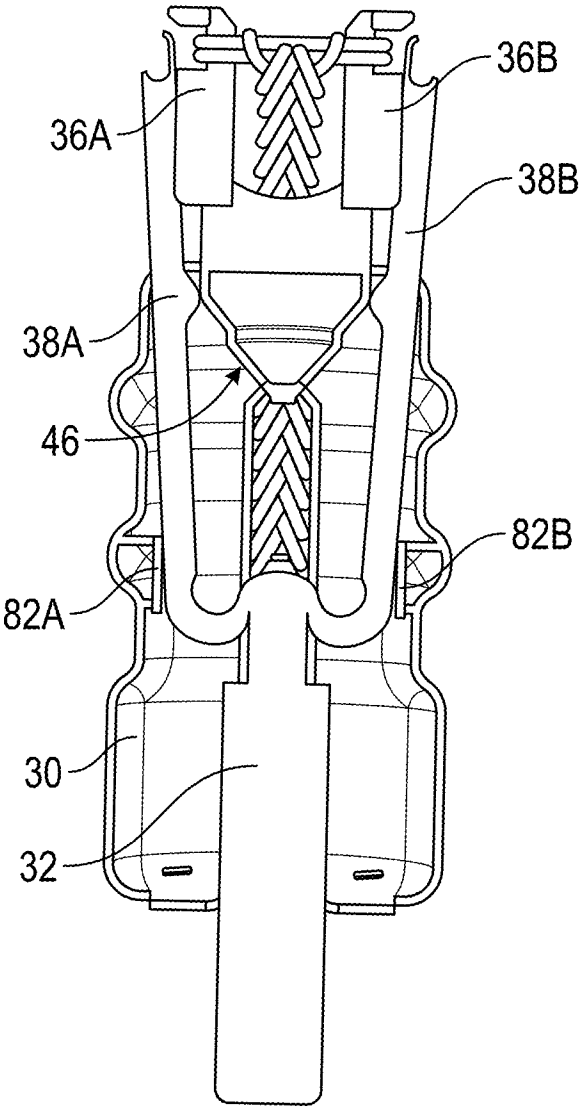
FIG. 27 is a view of the autoloom in a position where the elastic band is released from the finger and linked to other elastic bands.

Referring to FIGS. 27 and 28, further downward retraction of the slider 32 frees the elastic band 92 such that it links to the elastic bands of the linked item 96. The slider 32 is shown in a position that is moving toward the initial position shown in FIGS. 11 and 12. The fingers 50A-B have moved past the corresponding one of the flanges 40A-B and will are moving inwardly upon engagement with the return surfaces 82A-B.

Once the slider 32 has returned to the initial position, additional elastic bands are loaded onto the posts 36A-B and the process repeated. The movement of the arms 36A-B is defined and repeatable to speed the creation of a liked item.

Accordingly, the disclosed example autoloom 22 provides for the creation of a linked item with precise defined movement of the slider 32 relative to the guide 30. Moreover, the autoloom 22 provides for creation of linked items by provides features that support elastic bands and that uses simple repeatable steps.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A kit for forming an item from closed loop elastic bands, the kit comprising:

a plurality of closed loop elastic bands; and a device comprising:

a guide including at least two posts spaced apart from each other, each of the at least two posts including an outwardly extending flange configured to hold at least one closed loop elastic band therebetween; and a slider having at least two arms movable relative to the at least two posts, each of the at least two the arms including a finger portion having a hook and a push surface, the hook configured to pick a lowermost elastic band supported on a corresponding one of each of the at least two posts and the push surface configured to push an elastic band over the outwardly extending flange; and a cover attachable to the guide for holding at least a portion of the slider within the guide.

2. The kit as recited in claim 1, wherein the guide includes a cam surface and each of the at least two arms of the slider include a lobe surface that engages the cam surface of the guide to define relative movement of each of the at least two arms to a corresponding one of the at least two posts in response to movement of the slider relative to the guide, wherein the defined relative movement includes movement of the at least two arms in a manner that removes a closed loop elastic band placed across the at least two posts.

3. The kit as recited in claim 2, wherein the cam surface includes a first portion configured to move the at least two arms away from a corresponding one of the at least two posts.

4. The kit as recited in claim 3, wherein each of the at least two posts include a guide groove that extends through the outwardly extending flange and the cam surface comprises a portion of a bottom surface of the guide groove.

5. The kit as recited in claim 1, wherein each pole of the at least two posts include a band support area configured to position an elastic band relative to a corresponding one of the at least two arms.

6. The kit as recited in claim 1, wherein each outwardly extending flange includes a ramp for guiding a captured elastic band over the outwardly extending flange and a back side for holding an elastic band for release from the at least two arms.

7. The kit as recited in claim 1, wherein each of the at least two posts include a guide groove that extends through the outward extending flange and wherein a corresponding arm of the at least two arms slide within the guide groove of a corresponding one of the two posts.

8. The kit as recited in claim 1, wherein the guide includes an opening and the slider includes a guide tab that extends into the guide for guiding movement of the slider.

9. The kit as recited in claim 8, wherein the guide includes a bias hook and wherein the guide tab and the bias hook are configured to hold an elastic member therebetween to bias the slider toward an initial position.

10. The kit as recited in claim 8, wherein the slider includes an actuation portion from which each of the at least two arms extend, the actuation portion configured for manipulation by an operator to move the slider relative to the guide.

11. The kit as recited in claim 10, wherein each of the at least two arms include a spring portion that generates an inward bias of the at least two arms.

12. The kit as recited in claim 1, wherein the slider comprises a single unitary integral part.

13. The kit as recited in claim 1, further comprising a clip for securing a first end closed loop elastic band of the item formed from at least some of the plurality of closed loop elastic bands to a second end closed loop elastic band of the item.

14. A device for forming an item from closed loop elastic bands, the device comprising:

a guide having at least two posts spaced apart from each other, the at least two posts configured to hold at least one closed loop elastic band therebetween;

a slider having at least two arms movable relative to the at least two posts, each of the at least two arms including an end include a finger portion having a hook and a push surface, the hook configured to pick a lowermost elastic band supported across the at least two posts and the push surface is configured to push an elastic band off of a corresponding one of the at least two posts, wherein the guide further includes a cam surface and each of the at least two arms includes a lobe surface that engages the cam surface of the guide to define relative movement of each of the at least two arms to a corresponding one of the at least two posts in response to movement of the slider relative to the guide and a spring portion that generates an inward bias on the at least two arms that holds the lobe surface against the cam surface of the guide; and a cover attached to the guide to define a space and the slider is disposed within the space and moveable relative to the guide and the cover, wherein the defined relative movement includes movement of the at least two arms in a manner that removes a closed loop elastic band placed across the at least two post.

15. The device as recited in claim 14, wherein each pole of the at least two posts includes an outward extending flange and a guide groove, wherein each outwardly extending flange includes a ramp for guiding a captured elastic band over the outwardly extending flange and a back side for holding an elastic band for release from the at least two arms and the guide groove extends through the outward extending flange and a corresponding arm of the at least two arms slides within the guide groove of a corresponding one of the two posts.

16. The device as recited in claim 15, wherein the cam surface includes a first portion configured to move the at least two arms away from each other and a second portion configured to move the at least two arms toward each other, and wherein the second portion defines a bottom surface of the guide groove.

17. The device as recited in claim 16, wherein each of the at least two posts include a band support area disposed between the outwardly extending flange and a lower ledge, wherein the cam surface is configured to cause outward movement of the hook beginning at the lower ledge to facilitate engagement of a lower most elastic band disposed at the lower ledge.

18. The device as recited in claim 17, including a biasing member disposed between the guide and the slider for biasing the slider toward an initial position, wherein each of the hooks are disposed below the lower ledge in the initial position.

19. A method of forming a Brunnian link using a closed loop elastic band, the method comprising:

placing at least two closed loop elastic bands across at least two posts;

moving one arm of at least two arms relative to each of the at least two posts to generate outward movement of each arm relative to the at least two posts;

picking one of the at least two closed loop elastic bands off the at least two posts with the at least two arms with the outward movement of each arm;

extending each of the at least two arms upward and outward over an outwardly extending flange on each of the at least two posts such that the one closed loop elastic band picked by off the at least two posts slides over the outwardly extending flange;

retracting the at least two arms downwardly back past the outwardly extending flange to release the picked one closed loop elastic band from the at least two arms and links to the other of the at least two closed loop elastic bands remaining on the at least two posts; and repeating the above steps with at least one additional closed loop elastic band to create additional links.

20. The method as recited in claim 19, further comprising guiding a lobe on each of the at least two arms along a cam surface to generate the outward movement of the at least two arms.

21. The method as recited in claim 20, further comprising picking the one of the at least two closed loop elastic bands from the at least two posts with a finger portion on each of the at least two arms.

22. The method as recited in claim 21, further comprising moving the one of the at least two closed loop elastic bands over a ramp of the outwardly extending flange to release the picked closed loop elastic band from the at least two posts and releasing the picked closed loop elastic band from the at least two arms by engagement with a back side of the outwardly extending flange.

23. The method as recited in claim 19, further comprising generating outward and inward movement of the at least two arms relative to the at least two posts in response to sliding movement in a direction transverse to the outward and inward movement of the at least two arms.

24. A kit for forming an item from closed loop elastic bands, the kit comprising:

a plurality of closed loop elastic bands; and a device comprising:

a guide including two posts spaced apart from each other, each of the two posts include an outwardly extending flange configured to hold at least one closed loop elastic band therebetween;

a cover attached to the guide and defining a space between the guide and the cover; and a slider movably supported within the space between the guide and the cover, the slider comprising two arms corresponding with the two posts, wherein movement of the slider moves the two arms relative to a corresponding one of the two posts, each of the two arms further comprise a finger portion having a hook and a push surface, the hook is configured to pick a lowermost elastic band supported below at least one other elastic band supported across the two posts and the push surface is configured to push an elastic band over the outwardly extending flange.

25. The kit as recited in claim 24, wherein the guide includes a cam surface and each of the two arms of the slider include a lobe surface that engages the cam surface of the guide to define relative movement of each of the two arms to a corresponding one of the two posts in response to movement of the slider relative to the guide, wherein the defined relative movement includes movement of the two arms in a manner that removes a closed loop elastic band placed across the two posts.

26. The kit as recited in claim 25 wherein the cam surface includes a first portion configured to move the two arms away from a corresponding one of the two posts.

27. The kit as recited in claim 26, wherein each of the two posts include a guide groove that extends through the outward extending flange and the cam surface comprises a portion of a bottom surface of the guide groove.

28. The kit as recited in claim 24, wherein each of the two posts include a band support area configured to position an elastic band relative to a corresponding one of the two arms.

29. The kit as recited in claim 24, wherein each outwardly extending flange includes a ramp for guiding a captured elastic band over the outwardly extending flange and a back side for holding an elastic band for release from the two arms.

30. The kit as recited in claim 24, wherein each of the two posts include a guide groove that extends through the outward extending flange and wherein a corresponding arm of the two arms slide within the guide groove of a corresponding one of the two posts.

31. The kit as recited in claim 30, wherein the guide includes an opening and the slider includes a guide tab that extends into the guide for guiding movement of the slider.

32. The kit as recited in claim 31, wherein the guide includes a bias hook and wherein the guide tab and the bias hook are configured to hold an elastic member therebetween to bias the slider toward an initial position.

33. The kit as recited in claim 24, wherein the slider includes an actuation portion from which each of the two arms extend, the actuation portion configured for manipulation by an operator to move the slider relative to the guide.

34. The kit as recited in claim 24, wherein each of the two arms include a spring portion that generates an inward bias of the two arms.

35. The kit as recited in claim 24, further comprising a clip for securing a first end closed loop elastic band of the item formed from at least some of the plurality of closed loop elastic bands to a second end closed loop elastic band of the item.

* * * * *